US007487645B2

(12) United States Patent
Sasaki et al.

(10) Patent No.: US 7,487,645 B2
(45) Date of Patent: Feb. 10, 2009

(54) AUTOMATIC ICEMAKER

(75) Inventors: Naotaka Sasaki, Kiryu (JP); Kenji Sugaya, Kiryu (JP); Hideaki Ito, Gunma-ken (JP)

(73) Assignee: Japan Servo Co., Ltd., Tokyo (JP)

( * ) Notice: Subject to any disclaimer, the term of this patent is extended or adjusted under 35 U.S.C. 154(b) by 374 days.

(21) Appl. No.: 11/315,257

(22) Filed: Dec. 23, 2005

(65) Prior Publication Data

US 2006/0137382 A1 Jun. 29, 2006

(30) Foreign Application Priority Data

Dec. 28, 2004 (JP) ..... 2004-378341
Jan. 24, 2005 (JP) ..... 2005-015500

(51) Int. Cl.
*F25C 1/12* (2006.01)

(52) U.S. Cl. ..... 62/135; 62/208; 62/353

(58) Field of Classification Search ..... 62/135, 62/208–209, 353
See application file for complete search history.

(56) References Cited

U.S. PATENT DOCUMENTS 3,388,560 A * 6/1968 Moreland, II ..... 62/353
3,739,595 A * 6/1973 Learn et al. ..... 62/135
4,852,359 A * 8/1989 Manzotti ..... 62/68
5,010,738 A 4/1991 Brown et al.
5,182,916 A * 2/1993 Oike et al. ..... 62/135
5,345,783 A * 9/1994 Nishikawa ..... 62/345
6,351,955 B1 * 3/2002 Oltman et al. ..... 62/71
6,438,988 B1 * 8/2002 Paskey ..... 62/353
6,742,351 B2 * 6/2004 Kim et al. ..... 62/352
6,951,113 B1 * 10/2005 Adamski ..... 62/3.62

FOREIGN PATENT DOCUMENTS

JP 49-56233 A 10/1972
JP 49-104242 A 10/1974
JP 05-296625 A 11/1993
JP 2003-161554 A 6/2003

* cited by examiner

*Primary Examiner*—William E Tapolcai
(74) *Attorney, Agent, or Firm*—Birch, Stewart, Kolasch & Birch, LLP

(57) ABSTRACT

An automatic icemaker according to the invention can be disposed in one part of a freezer and automatically make ice pieces, and is provided with temperature distribution forming means which forms a temperature distribution in which freezing progresses from the open side of ice partitions of an ice-tray and is completed near the bottom side of the ice partitions.

13 Claims, 8 Drawing Sheets

AUTOMATIC ICEMAKER

BACKGROUND OF THE INVENTION

1. Field of the Invention

The present invention relates to an automatic icemaker which carries out water supplying, ice making and ice discharging.

2. Description of the Related Art

A conventional automatic icemaker pours water into an ice-tray having a prescribed shape, detaches ice pieces from the ice-tray by using a heater after making the ice pieces by refrigerating the water with the cold air of the freezer, and scrapes out the ice pieces by turning an ice discharging arm with a motor.

Another conventional automatic icemaker twists the ice-tray to detach the produced ice pieces more easily from the ice-tray, thereby releases the ice pieces from its adhesion to the ice-tray, and transfers the ice pieces to an ice storage box.

In still another conventional automatic icemaker, a thermosensitive displacement element, typically a bimetal element or a shape memory element, whose shape varies at a temperature below 0° C., is arranged on the bottom face of each of the ice partitions provided in the ice-tray, and each ice piece is detached by the deforming force of this thermosensitive displacement element.

However, the conventional automatic icemaker equipped with an ice detaching heater, since it applies heat to the ice-tray by using a heater within the freezer, the power consumption of the freezer increases with a corresponding rise in the ice making cost.

In the second conventional automatic icemaker which detaches ice pieces from the ice-tray by twisting the ice-tray, the repetition of the water supplying, ice making and ice discharging sequence causes frequent stresses to be applied to the ice-tray, whose durability is thereby affected, resulting in a need to replace the ice-tray frequently.

For the conventional automatic icemaker which detaches ice pieces by the deforming force of thermosensitive displacement elements which requires installation of a thermosensitive displacement element on the bottom face of each of the ice partitions, the ice-tray is made expensive.

SUMMARY OF THE INVENTION

An object of the present invention, attempted to eliminate the disadvantages noted above, is to provide an automatic icemaker which allows ice pieces made in an ice-tray to be detached easily without increasing the power consumption of the freezer, having to replace the ice-tray frequently or making the ice-tray expensive.

According to one aspect of the invention, there is provided an automatic icemaker provided with temperature distribution forming means which forms a temperature distribution in which freezing progresses from the open side of ice partitions of an ice-tray and is completed near the bottom side of the ice partitions.

In this automatic icemaker, residual bubbles are formed toward the bottom side of the ice partitions and, when freezing is substantially completed, the residual bubbles rupture to enable the ice pieces to freely move within the ice partitions. Therefore, power consumption by the freezer is not increased, there is no need to frequently replace the ice-tray, moreover the cost of the ice-tray is not increased, and ice pieces made in the ice partitions can be easily detached.

BRIEF DESCRIPTION OF THE DRAWINGS

Other features and advantages of the present invention will become more apparent from the following detailed description when taken in conjunction with the accompanying drawings, wherein.

DETAILED DESCRIPTION OF THE INVENTION

Figure 1:
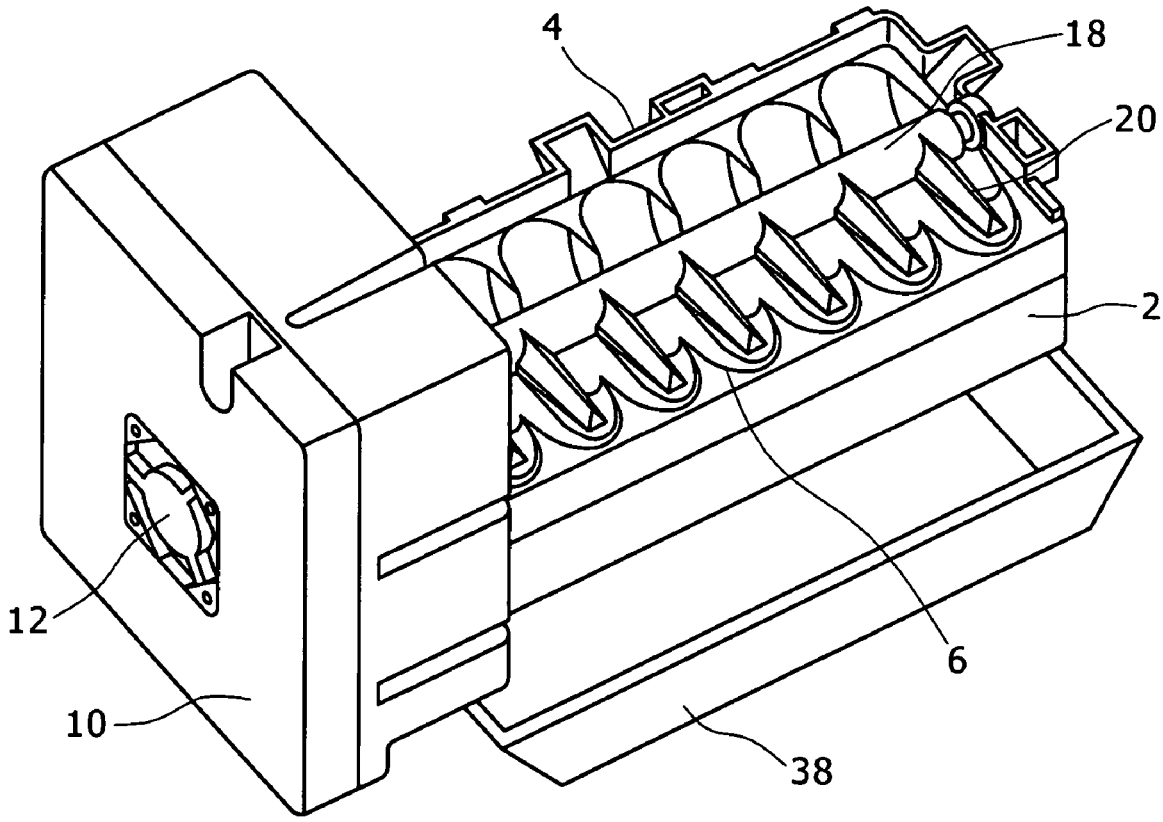
FIG. 1 shows a perspective view of an automatic icemaker according to the present invention.

An automatic icemaker according to the invention will be described below with reference to FIG. 1 through FIG. 3. An ice-tray 4 is fitted to an outer case 2. The ice-tray 4 has a plurality of concave ice partitions 6. An air layer 8 is formed between the outer case 2 and the ice-tray 4. The air layer 8 constitutes temperature distribution forming means which forms a temperature distribution in which freezing progresses from the open side of the ice partitions 6 of the ice-tray 4 and is completed near the bottom side of the ice partitions 6. A control box 10 is fixed to the outer case 2. The control box 10 is provided with an air blower 12. A wind tunnel 14 is connected to the air blower 12. The wind tunnel 14 has a wind tunnel wall 16. A revolving body 18 is revolvably supported by the control box 10. The revolving body 18 is provided with ice discharging claws 20. The revolving body 18 further has a main air duct 22 and branch air ducts 24. The main air duct 22 communicates with the wind tunnel 14, while the branch air ducts 24 communicate with the main air duct 22. A motor 26 is fixed to the control box 10. A pinion 28 is fitted to the output shaft of the motor 26. A driven gear 30 is fitted to the revolving body 18. The pinion 28 and the driven gear 30 mesh with each other. The air blower 12, the wind tunnel 14 and the revolving body 18 constitute another temperature distribution forming means which forms a temperature distribution in which freezing progresses from the open side of the ice partitions 6 of the ice-tray 4 and is completed near the bottom side of the ice partitions 6. A water injector 32 is disposed above the ice-tray 4. The water injector 32 is provided with a water injection valve 34. In contact with the ice partitions 6, there are disposed ice making sensors 36 which detect the completion of freezing by sound, vibration or a combination of temperature and a temperature variation profile. Underneath the outer case 2, there is arranged an ice storage box 38 for storing ice pieces discharged from the ice-tray 4.

A controller 42 formed of an electronic circuit having a CPU, a microprocessor and so forth is disposed in the control box 10. The ice making sensors 36, an internal temperature sensor 44 and a fullness detecting sensor 46 are connected to the controller 42. The internal temperature sensor 44 detects the temperature within the freezer in which the automatic icemaker is installed. The fullness detecting sensor 46 detects that ice pieces have reached a prescribed quantity in the ice storage box 38. A motor control circuit 48 for controlling the motor 26, an air blower control circuit 50 for controlling the air blower 12 and the water injection valve control circuit 52 for controlling the water injection valve 34 are connected to the controller 42.

Figure 2:
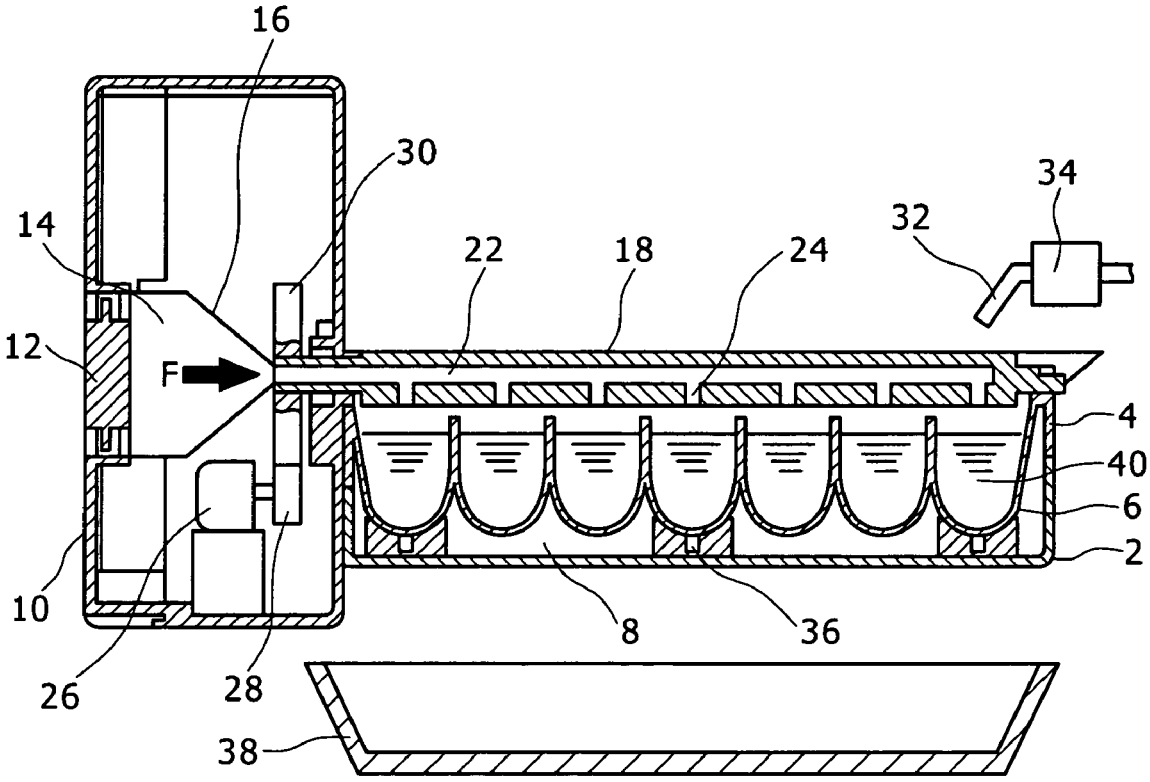
FIG. 2 is a sectional view of the automatic icemaker shown in FIG. 1.
Figure 3:
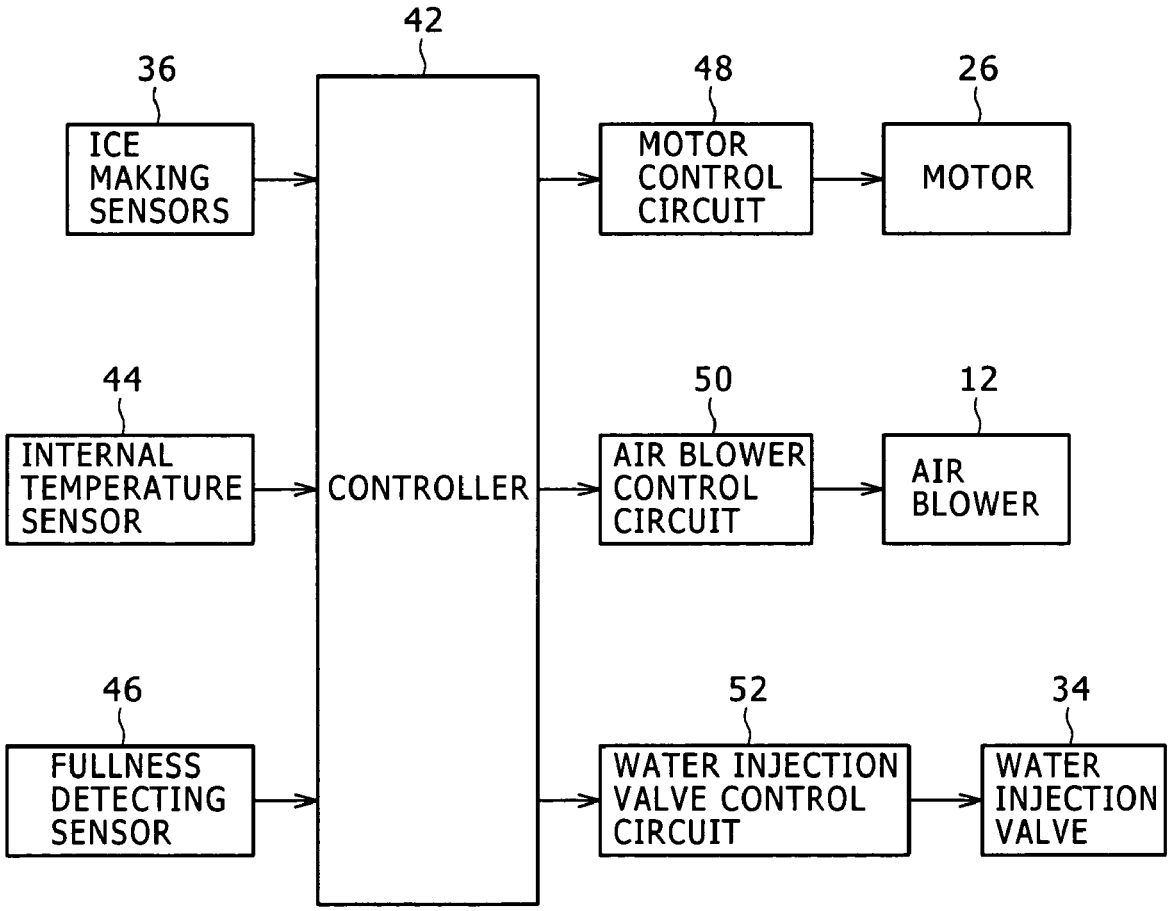
FIG. 3 is a system block diagram of the automatic icemaker shown in FIG. 1 and FIG. 2.

In the automatic icemaker shown in FIG. 1 through FIG. 3, a bracket (not shown) provided on the ice-tray 4 is fixed to an engaging portion disposed in advance in the freezer. When the controller 42 is instructed to start an ice making cycle, the controller 42 sends a valve opening signal to the water injection valve 34 via the water injection valve control circuit 52 to open the water injection valve 34, and water begins to be injected from the water injector 32 into each of the ice partitions 6. When a prescribed length of time has passed since the start of water injection and each of the ice partitions 6 is filled with a prescribed quantity of water, the controller 42 sends a valve closing signal to the water injection valve 34 via the water injection valve control circuit 52 to close the water injection valve 34, and water injection by the water injector 32 is stopped.

Figure 4:
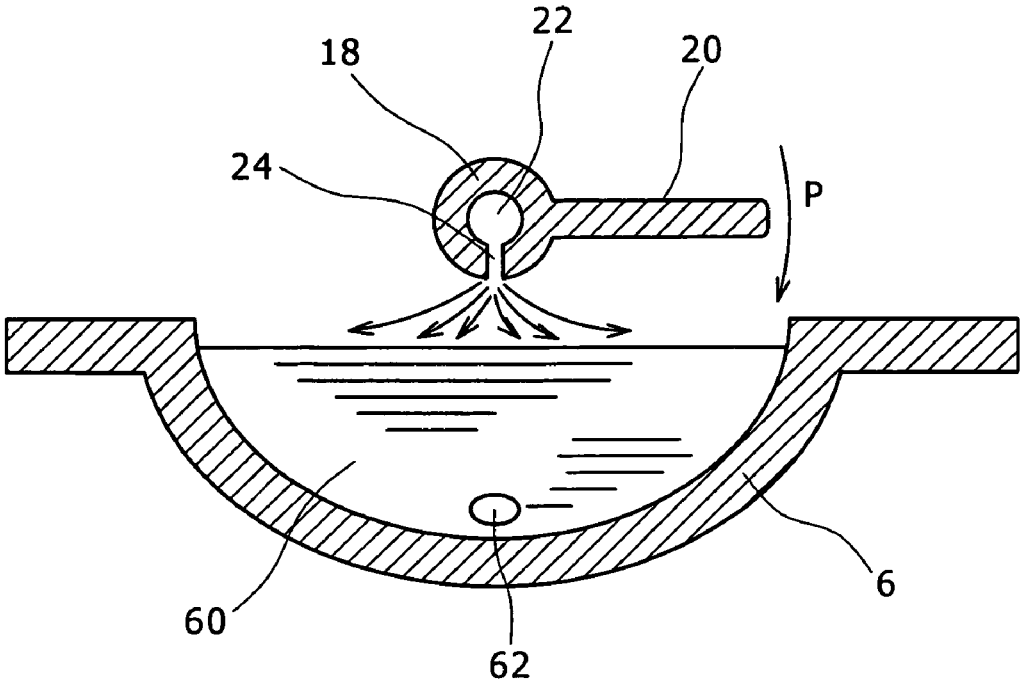
FIG. 4 shows a state of the automatic icemaker shown in FIG. 1 and FIG. 2 immediately before the completion of freezing.

Next, the controller 42 starts the air blower 12 via the air blower control circuit 50. The cold air of the freezer supplied by the air blower 12 is converged in the F direction within the wind tunnel 14 and, as shown in FIG. 4, the cold air is blown from the branch air ducts 24 into each of the ice partitions 6 via the main air duct 22. In this state, the controller 42 controls the motor 26 via the motor control circuit 48, and the motor 26 repeats forward and reverse revolutions at appropriate angles. Accordingly the revolving body 18 is repeatedly oscillated between the clockwise and counterclockwise directions in the illustration of FIG. 4, resulting in variations of the blowing direction of the cold air.

In this case, the cold air blown out of the branch air ducts 24 hits water 40 accumulated within the ice partitions 6 and, as the ice-tray 4 is intercepted from the cold air of the freezer by the air layer 8, the temperature distribution within the ice partitions 6 is formed with such a temperature gradient that freezing progresses from the open side of the ice partitions 6. As a result, freezing progresses from the open side of the ice partitions 6 which are exposed to the cold air and, immediately before the completion of freezing, ice pieces 60 are in a state in which residual bubbles 62 contained in the water 40 gather while being gradually compressed on the bottom side of the ice partitions 6.

Figure 5:
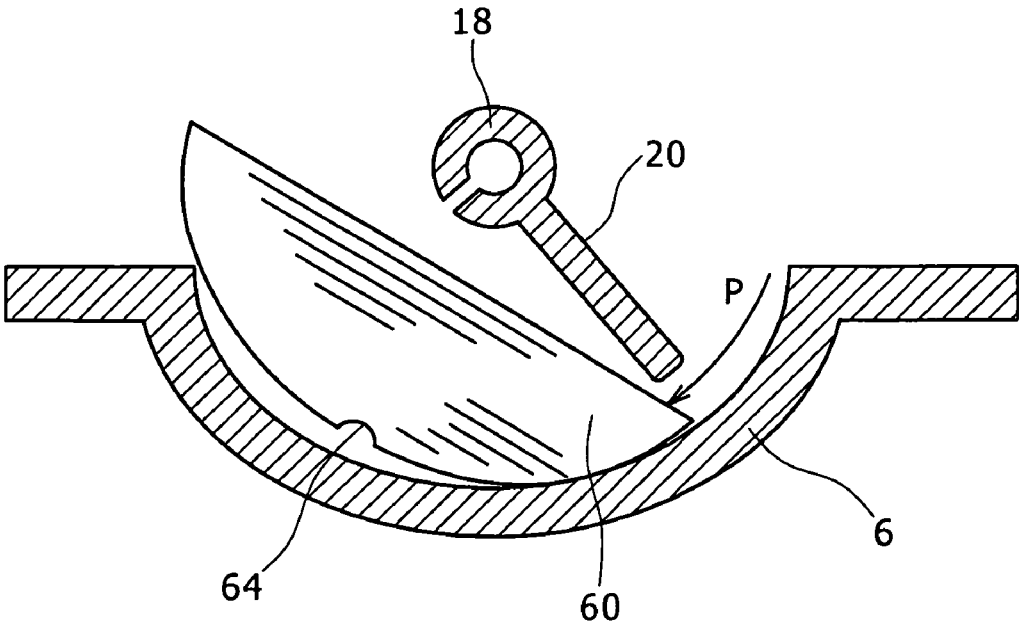
FIG. 5 shows the automatic icemaker shown in FIG. 1 and FIG. 2 in an ice discharging state.

When freezing is substantially completed, the ice pieces 60 surrounding the residual bubbles 62, especially parts of the ice pieces 60 toward the ice partitions 6, can no longer bear the compression and will be broken. Thus, the residual bubbles 62 will rupture. As a result, each of the ice pieces 60 will have a slight notch 64 as shown in FIG. 5. The rupturing force of the residual bubbles 62 is so strong as to release the ice pieces 60 from adhesion to the respective ice partitions 6 and enable them to freely move within the ice partitions 6. The rupture of the residual bubbles 62 is detected by the ice making sensors 36. When the ice making sensors 36 has detected the rupture of the residual bubbles 62, the controller 42 turns the revolving body 18 in the direction of arrow P by controlling the motor 26 via the motor control circuit 48; the ice pieces 60 are scraped out of the ice partitions 6 by the ice discharging claws 20 as shown in FIG. 5 and dropped into the ice storage box 38 to complete an ice making cycle. After that, water is again injected from the water injector 32 to begin the next ice making cycle. As the ice making cycle is repeated in this way, the ice pieces 60 are accumulated in the ice storage box 38 in which the discharged ice pieces are to be stocked. When the fullness detecting sensor 46 detects that the ice pieces 60 have reached their prescribed quantity and the controller 42 detects a signal from the fullness detecting sensor 46, the controller 42 temporarily suspends the ice making cycle. When the user takes some of the ice pieces 60 out of the ice storage box 38, the fullness detecting sensor 46 detects that the ice pieces 60 in the ice storage box 38 are less than their prescribed quantity, the controller 42 detects another signal from the fullness detecting sensor 46, and the controller 42 restarts the ice making cycle.

If, during an ice making cycle, the temperature differs from its due level as a result of the door of the freezer remaining open while the automatic icemaker is in operation, the controller 42 will find the state as being abnormal, and perform an abnormality remedy determined in advance for each particular step. The output of the internal temperature sensor 44 is used as the reference for detection of a frozen state or for detecting any other abnormality within the freezer.

Thus in the automatic icemaker shown in FIG. 1 through FIG. 3, since the temperature distribution within the ice partitions 6 is formed with such a temperature gradient that freezing progresses from the open side of the ice partitions 6, residual bubbles 62 are formed toward the bottom side of the ice partitions 6; when freezing is substantially completed, the residual bubbles 62 rupture to release the ice pieces 60 from adhesion to the respective ice partitions 6 and enable them to freely move within the ice partitions 6. Therefore, since there is no need to heat the ice-tray within the freezer by using a heater as in one of the conventional configurations, power consumption by the freezer is not increased, accordingly entailing no cost rise. Nor is there any need to twist the ice-tray to detach the ice pieces from the ice-tray, and accordingly the ice-tray is not subjected to frequent stresses, necessitating no frequent replacement of the ice-tray. Furthermore, since no thermosensitive displacement element is required, the ice-tray can be manufactured at low cost. Furthermore, when cold air is to be blown on the open side of the ice partitions 6, as the revolving body 18 is repeatedly oscillated between the clockwise and counterclockwise directions in the illustration of FIG. 4, the cold air blown out of the branch air ducts 24 can be uniformly dispersed on the open side of the ice partitions 6, with the result that freezing within the ice partitions 6 is enabled to progress uniformly.

Another automatic icemaker will now be described with reference to FIG. 6 and FIG. 7. An ice-tray 74 is fitted to an outer case 72. The ice-tray 74 has a plurality of concave ice partitions 76. An air layer 78 is formed between the outer case 72 and the ice-tray 74. The air layer 78 constitutes temperature distribution forming means which forms a temperature distribution in which freezing progresses from the open side of the ice partitions 76 of the ice-tray 74 and is completed near the bottom side of the ice partitions 76. The control box 80 is fixed to the outer case 72. A revolving body 82 is revolvably supported by the control box 80. The revolving body 82 is provided with ice discharging claws 84. A motor 86 is fixed to the control box 80. A pinion 88 is fitted to the output shaft of the motor 86. A driven gear 90 is fitted to the revolving body 82. The pinion 88 and the driven gear 90 mesh with each other. A water feed box 92 is disposed above the ice-tray 74. The water feed box 92 is provided with a water injecting solenoid valve 94. A first temperature sensor 96 is disposed at the bottom of an ice partition 76. A second temperature sensor 98 is arranged near the open face of the ice partition 76. Underneath the outer case 72, there is provided an ice storage box (not shown) for storing ice pieces discharged from the ice-tray 74.

A controller 102 formed of an electronic circuit having an AD converter and a microprocessor or a microprocessor with a built-in AD converter is disposed in the control box 80. The temperature sensor 96, the temperature sensor 98 and a fullness detecting sensor 104 are connected to the controller 102. The controller 102 consecutively reads in signal voltages corresponding to the temperatures detected by the temperature sensors 96 and 98, subjects the signal voltages to AD conversion, and thereby figures out the difference between the temperatures detected by the temperature sensor 96 and those detected by the temperature sensor 98, namely temperature difference. The fullness detecting sensor 104 detects that ice pieces have reached a prescribed quantity in the ice storage box. A motor control circuit 106 for controlling the motor 86 and a solenoid valve control circuit 108 for controlling the water injecting solenoid valve 94 are connected to the controller 102.

In this automatic ice maker, when the controller 102 is instructed to start an ice making cycle, the controller 102 sends a valve opening signal to the water injecting solenoid valve 94 via the solenoid valve control circuit 108 to open the water injecting solenoid valve 94, and water injection from the water feed box 92 to the ice partitions 76 is started. When a prescribed length of time has passed since the start of water injection and each of the ice partitions 76 is filled with a prescribed quantity of water, the controller 102 sends a valve closing signal to the water injecting solenoid valve 94 via the solenoid valve control circuit 108 to close the water injecting solenoid valve 94, and water injection from the water feed box 92 is stopped.

Figure 8:
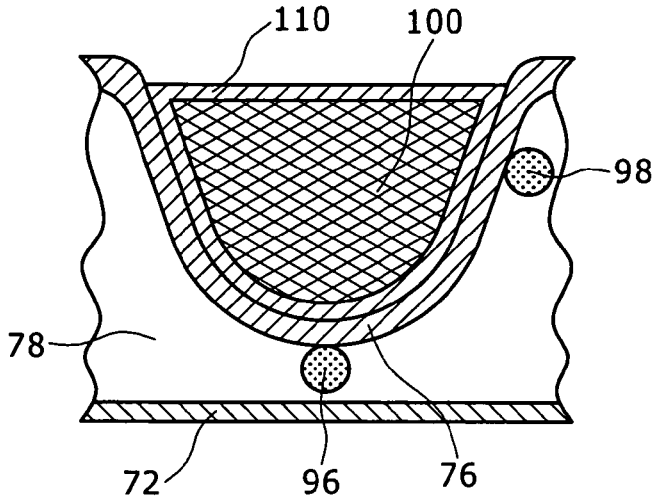
FIG. 8 illustrates a stage of the freezing process of water in the automatic icemaker shown in FIG. 6.

Then, as shown in FIG. 8, water 100 poured into the ice partitions 76 is frozen first in the portion in the opening faces of the ice partitions 76 directly exposed to the cold air of the freezer and the portion in contact with the inner walls of the ice partitions 76, and ice pieces 110 are so formed as to surround the water 100.

Figure 9:
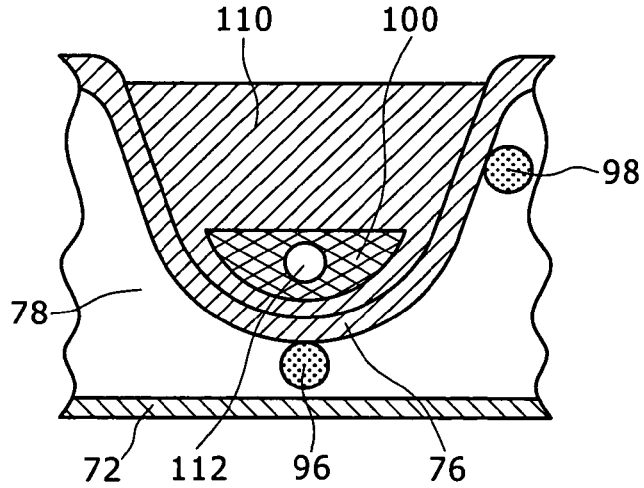
FIG. 9 illustrates the next stage of the freezing process of water in the automatic icemaker shown in FIG. 6.
Figure 10:
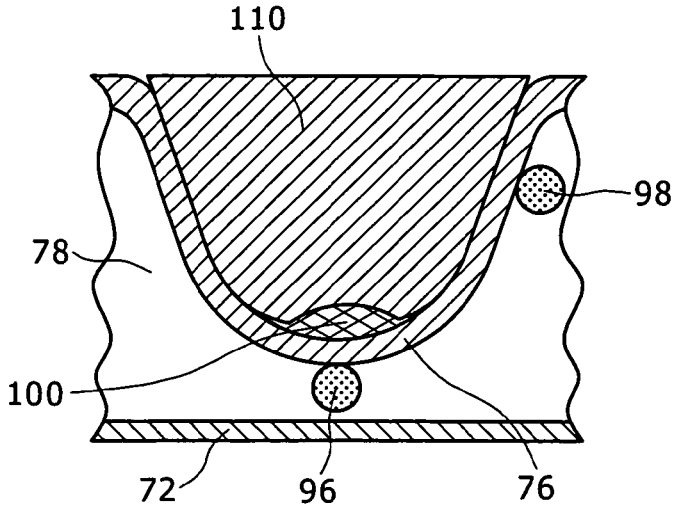
FIG. 10 illustrates the further next stage of the freezing process of water in the automatic icemaker shown in FIG. 6.

When more time has passed, since the bottoms of the ice partitions 76 are intercepted from the cold air of the freezer by the air layer 78, freezing progresses from the open faces toward the bottoms of the ice partitions 76, and air driven out of the ice pieces 110 when the water 100 is frozen gathers in the unfrozen portion of water 100 near the bottom side of the ice partitions 76 to give rise to residual bubbles 112 as shown in FIG. 9. When freezing further progresses from this state, the ice pieces 110 expand in the freezing process and, since the freezing progresses from the open faces onward, the generated residual bubbles 112 are compressed near the bottom side of the ice partitions 76.

When time elapses still further and freezing is substantially completed, the ice pieces 110 surrounding the residual bubbles 112, especially parts of the ice pieces 110 on the bottom side of the ice partitions 76 can no longer bear the compression and will be broken. Thus, the residual bubbles 112 will rupture. As a result, unfrozen very small portions of water 100 are discharged from within the ice pieces 110 toward the bottoms of the ice partitions 76. In this case, the portion of water 100 discharged from within the ice pieces 110 comes into contact with the bottoms of the ice partitions 76. The rupturing force of the residual bubbles 112 is so strong as to release the ice pieces 110 from adhesion to the respective ice partitions 76 and enable them to freely move within the ice partitions 76.

Figure 11:
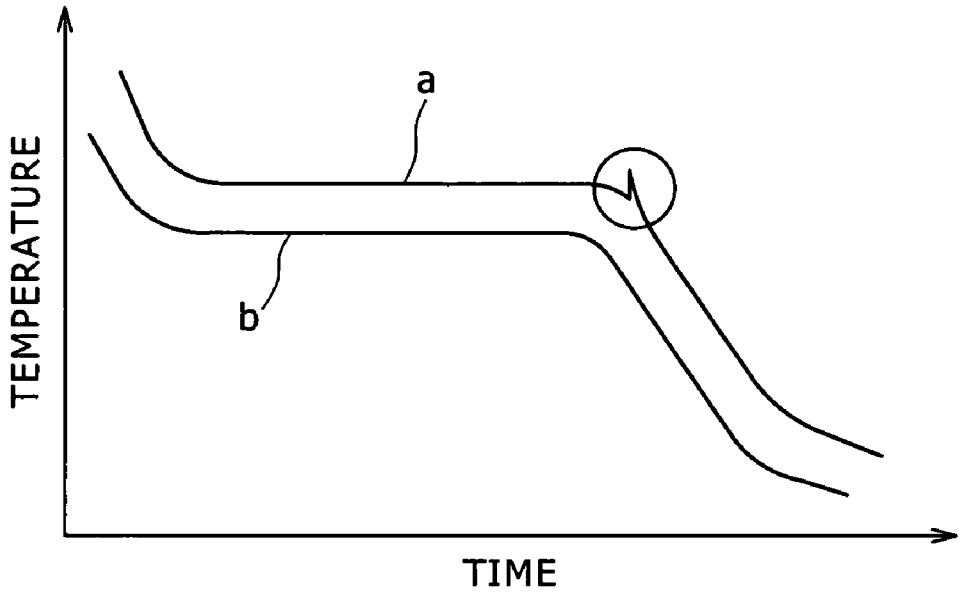
FIG. 11 is a graph showing temperature variations of the ice-tray in the automatic icemaker shown in FIG. 6.
Figure 12:
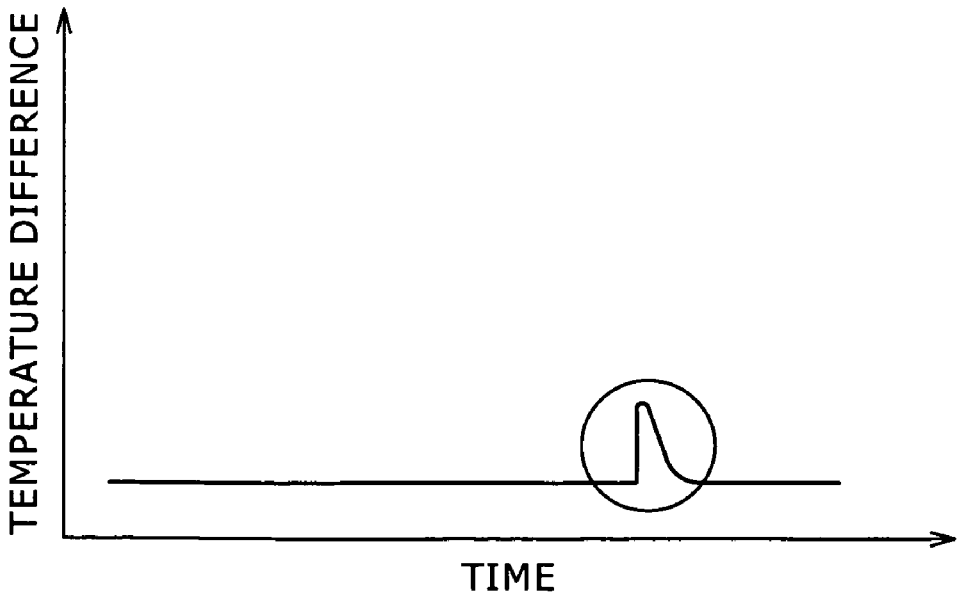
FIG. 12 is a graph showing temperature difference variation of the ice-tray in the automatic icemaker shown in FIG. 6.

FIG. 11 is a graph showing temperature variations of the ice partitions 76 detected by the temperature sensors 96 and 98, wherein line a represents the variation of the temperature detected by the temperature sensor 96 and line b represents the variation of the temperature detected by the temperature sensor 98. FIG. 12 shows the difference between the temperatures detected by the temperature sensor 96 and those detected by the temperature sensor 98, namely temperature difference. Since the air layer 78 is formed between the outer case 72 and the ice-tray 74 and therefore the ice partitions 76 are intercepted from the cold air of the freezer by the air layer 78, the temperature detected by the temperature sensor 98, namely the temperature in the vicinities of the open faces of the ice partitions 76 directly exposed to the cold air of the freezer, is lower than the temperature detected by the temperature sensor 96, namely the temperature at the bottoms of the ice partitions 76. After water is injected, the cold air within the freezer refrigerates the ice partitions 76 and the temperature therein falls to start freezing the water; while the freezing heat of water is being absorbed, the temperatures detected by the temperature sensors 96 and 98 are substantially constant. When the residual bubbles 112 rupture and unfrozen very small portions of water 100 come into contact with the bottoms of the ice partitions 76, the temperature detected by the temperature sensor 96 temporarily rises, resulting in a transient widening of the temperature difference.

The controller 102 determines that freezing has been completed when the temperature difference temporarily widens. Upon determination of the completion of freezing, the controller 102 controls the motor 86 via the motor control circuit 106 to turn the revolving body 82, scrapes the ice pieces 110 off the ice partitions 76 with the ice discharging claws 84, and lets the ice pieces 110 drop into the ice storage box to complete an ice making cycle. After that, water is again poured from the water feed box 92 to begin the next ice making cycle. As the ice making cycle is repeated in this way, the ice pieces 110 are accumulated in the ice storage box in which the discharged ice pieces are to be stocked. When the fullness detecting sensor 104 detects that the ice pieces 110 have reached their prescribed quantity and the controller 102 detects a signal from the fullness detecting sensor 104, the controller 102 temporarily suspends the ice making cycle. When the user takes some of the ice pieces 110 out of the ice storage box, the fullness detecting sensor 104 detects that the ice pieces 110 in the ice storage box are less than their prescribed quantity, the controller 102 detects another signal from the fullness detecting sensor 104, and the controller 102 restarts the ice making cycle.

If, during an ice making cycle, the temperature differs from its due level as a result of the door of the freezer remaining open while the automatic icemaker is in operation, the controller 102 will find the state as being abnormal, and perform an abnormality remedy determined in advance for each particular step.

Figure 6:
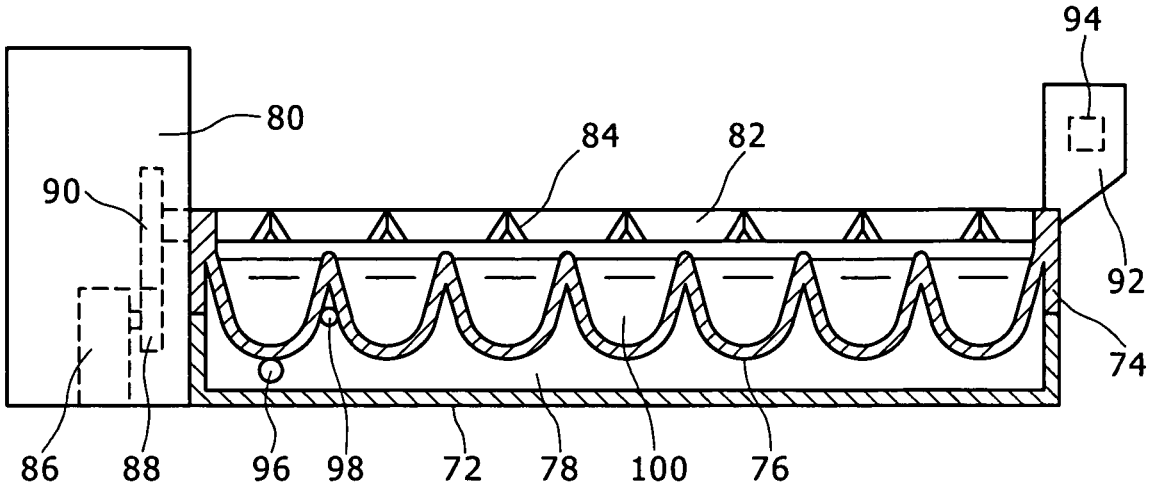
FIG. 6 shows a sectional view of another automatic icemaker according to the invention.
Figure 7:
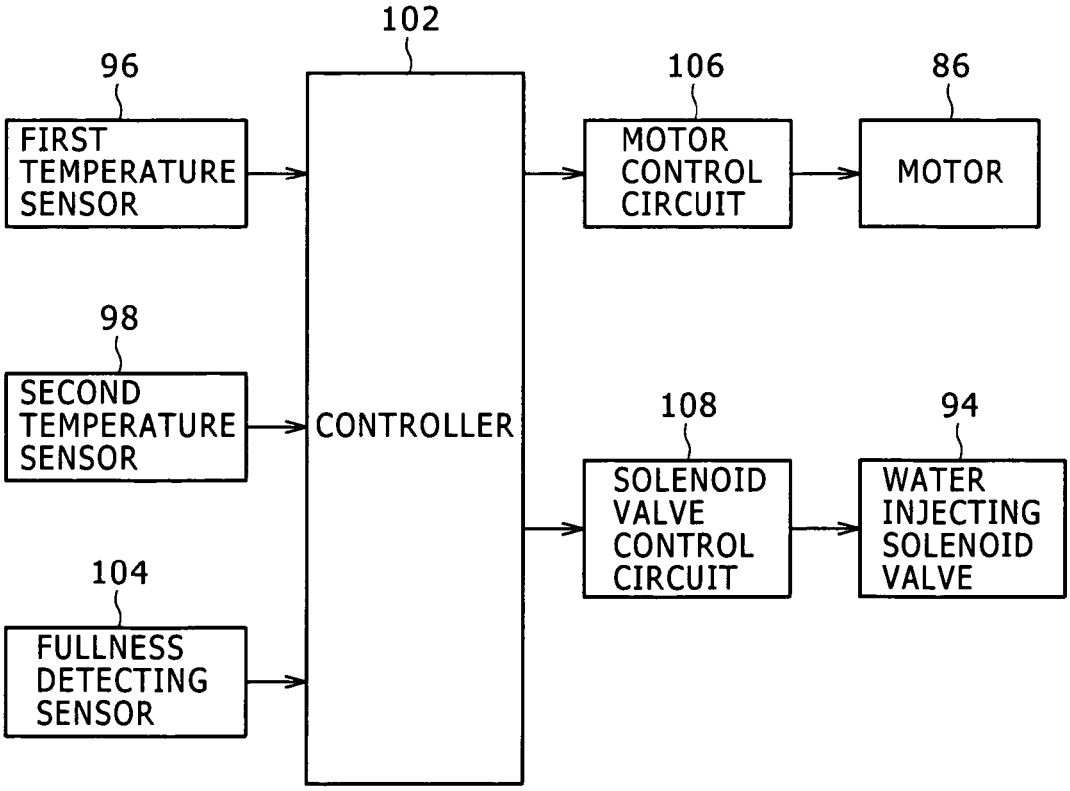
FIG. 7 is a system block diagram of the automatic icemaker shown in FIG. 6.

Thus in the automatic icemaker shown in FIG. 6 and FIG. 7, since the temperature distribution within the ice partitions 76 is formed with such a temperature gradient that freezing progresses from the open side of the ice partitions 76, residual bubbles 112 are formed toward the bottom side of the ice partitions 76; when freezing is substantially completed, the residual bubbles 112 rupture to release the ice pieces 110 from adhesion to the respective ice partitions 76 and enable them to freely move within the ice partitions 76. Therefore, power consumption by the freezer is not increased, there is no need to replace the ice-tray frequently, and moreover the ice-tray can be manufactured at low cost. Since the controller 102 determines that freezing has been completed when the temperature difference temporarily widens, it can reliably determine the completion of freezing without being affected by temperature variations within the freezer due to defrosting or some other action within the freezer. Further, as there is no need to take about twice as long a time as the actual freezing time to determine the completion of freezing according to a prescribed freezing determination temperature and freezing determination time, both set with ample margins, so as to tolerate fluctuations due to the cold air temperature or the way of fitting temperature sensors, the ice making capability can be enhanced.

Incidentally, though the temperature sensor 98 is located in the vicinities of the open faces of the ice partitions 76 in this embodiment of the invention, the second temperature sensor 98 can be installed in any position where the temperatures in the vicinities of the ice partitions 76 can be detected. Further, though in this embodiment the controller 102 determines that freezing has been completed when the temperature difference temporarily widens, the controller 102 can as well do so when the temperature detected by the temperature sensor 96 temporarily rises.

Now, still another automatic icemaker according to the invention will be described with reference to FIG. 13. A supporting member 120 is fixed to the control box 80. An air blower 122 is fitted to the supporting member 120. The air blower 122 is controlled by a controller in the control box 80. The air blower 122 constitutes temperature distribution forming means which forms a temperature distribution in which freezing progresses from the open side of the ice partitions 76 of the ice-tray 74 and is completed near the bottom side of the ice partitions 76.

Figure 13:
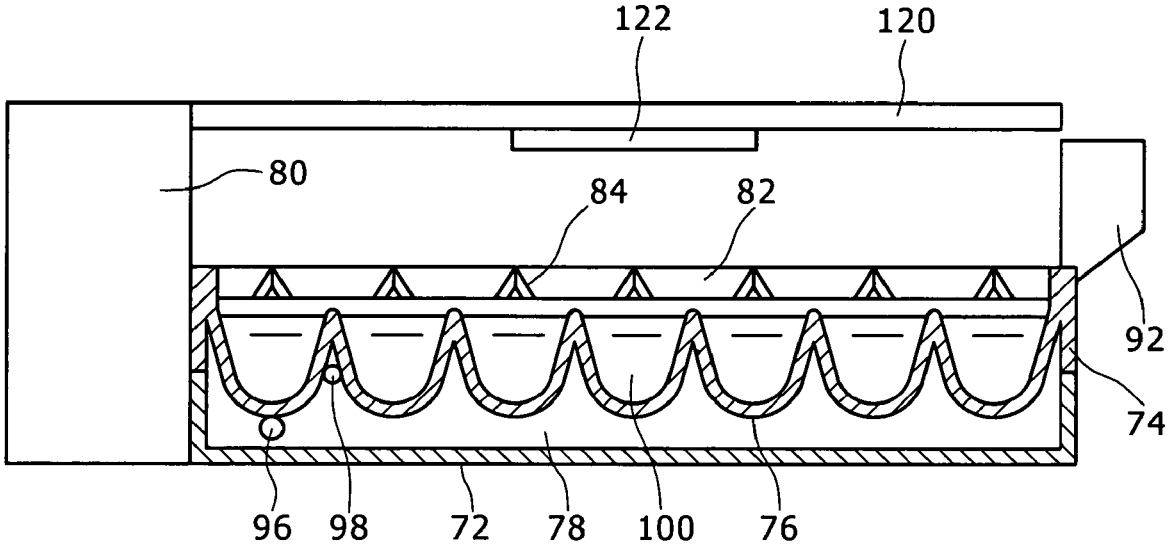
FIG. 13 shows a sectional view of still another automatic icemaker according to the invention.

In the automatic icemaker shown in FIG. 13, since the cold air blown from the air blower 122 hits water 100 held within the ice partitions 76 and the ice-tray 74 is intercepted from the cold air of the freezer by the air layer 78, such a temperature gradient that freezing progresses from the open side of the ice partitions 76 onward is formed within the ice partitions 76. As a result, freezing progresses from the open side of the ice partitions 6 which are exposed to the cold air and, immediately before the completion of freezing, residual bubbles contained in the water 100 gather while being gradually compressed on the bottom side of the ice partitions 76, and when freezing is substantially completed, the residual bubbles rupture.

Incidentally, though a single air blower 122 is used in this embodiment, a plurality of air blowers may as well be used. Also, an air flow outlet may be provided in the freezer to enable cold air to hit the open faces of the ice partitions 76.

To add, the air layer 8 or 78 may be filled with a porous material, such as a foam material.

The present invention is applicable to any automatic icemaker which can be disposed in one part of a freezer and automatically makes ice pieces in a prescribed ice making cycle.

What is claimed is:

1. An automatic icemaker which can be disposed in one part of a freezer and automatically make ice pieces, comprising:

a temperature distribution forming device that forms a temperature distribution in which freezing progresses from an open side of ice partitions of an ice-tray and is completed near a bottom side of said ice partitions; wherein an air layer is formed between said ice-tray and an outer case as said temperature distribution forming device; and air ducts are disposed within a revolving body provided with ice discharging claws, cold air being blown through said air ducts onto the open side of said ice partition.

2. The automatic icemaker, as set forth in claim 1, wherein the temperature distribution forming device blows cold air to the open side of said ice partitions to form the temperature distribution.

3. The automatic icemaker, as set forth in claim 1, wherein said revolving body is oscillated.

4. The automatic icemaker, as set forth in claim 1, further comprising a temperature sensor for detecting the temperature of the bottom side of said ice partitions and a controller that determines that freezing has been completed when the temperature detected by said temperature sensor temporarily rises.

5. The automatic icemaker, as set forth in claim 4, wherein said controller is formed of an electronic circuit having an AD converter and a microprocessor or a microprocessor with a built-in AD converter.

6. The automatic icemaker, as set forth in claim 1, further comprising:

a first temperature sensor for detecting the temperature at the bottom side of said ice partitions;

a second temperature sensor for detecting the temperature near the open side of said ice partitions; and a controller that determines that freezing has been completed when the difference between the temperature detected by said first temperature sensor and the temperature detected by said second temperature sensor temporarily widens.

7. The automatic icemaker, as set forth in claim 6, wherein said controller is formed of an electronic circuit having an AD converter and a microprocessor or a microprocessor with a built-in AD converter.

8. An automatic icemaker which can be disposed in one part of a freezer and automatically make ice pieces, comprising:

a temperature distribution forming device that forms a temperature distribution in which freezing progresses from an open side of ice partitions of an ice-tray and is completed near a bottom side of said ice partitions;

a first temperature sensor for detecting the temperature at the bottom side of said ice partitions;

a second temperature sensor for detecting the temperature near the open side of said ice partitions; and a controller that determines that freezing has been completed when the difference between the temperature detected by said first temperature sensor and the temperature detected by said second temperature sensor temporarily widens.

9. The automatic icemaker, as set forth in claim 8, wherein said controller is formed of an electronic circuit having an AD converter and a microprocessor or a microprocessor with a built-in AD converter.

10. The automatic icemaker, as set forth in claim 8, wherein the temperature distribution forming device blows cold air to the open side of said ice partitions to form temperature distribution.

11. The automatic icemaker, as set forth in claim 10, wherein air ducts are disposed within a revolving body provided with ice discharging claws, and cold air blown through said air ducts onto the open side of said ice partition.

12. The automatic icemaker, as set forth in claim 11, wherein said revolving body is oscillated.

13. The automatic icemaker, as set forth in claim 8, wherein an air layer is formed between said ice-tray and an outer case as said temperature distribution forming device.

* * * * *